US007111329B2

(12) United States Patent
Stroud et al.

(10) Patent No.: US 7,111,329 B2
(45) Date of Patent: Sep. 26, 2006

(54) HELMET REINFORCEMENT SYSTEM

(75) Inventors: David E. Stroud, Santa Cruz, CA (US); David T. Debus, Watsonville, CA (US)

(73) Assignee: Bell Sports, Inc., Irving, TX (US)

( * ) Notice: Subject to any disclaimer, the term of this patent is extended or adjusted under 35 U.S.C. 154(b) by 0 days.

(21) Appl. No.: 10/879,421

(22) Filed: Jun. 29, 2004

(65) Prior Publication Data

US 2005/0283885 A1 Dec. 29, 2005

(51) Int. Cl.
*A42B 1/06* (2006.01)
*A63B 71/10* (2006.01)

(52) U.S. Cl. ..... 2/410; 2/7; 2/171.3

(58) Field of Classification Search ..... 2/410, 2/7, 411, 412, 425, 171.3, 184.5
See application file for complete search history.

(56) References Cited

U.S. PATENT DOCUMENTS

| | | | | | |
|---|---|---|---|---|---|
| 4,081,865 | A | * | 4/1978 | Bergee et al. | 2/425 |
| 4,115,874 | A | * | 9/1978 | Hasegawa | 2/425 |
| 5,007,141 | A | | 4/1991 | Gentes | 24/163 R |
| 5,088,130 | A | * | 2/1992 | Chiarella | 2/411 |
| 5,093,937 | A | * | 3/1992 | Kamata | 2/424 |
| 5,093,938 | A | * | 3/1992 | Kamata | 2/424 |
| 5,099,523 | A | | 3/1992 | Broersma | 2/411 |
| 5,119,516 | A | | 6/1992 | Broersma | 2/411 |
| 5,231,703 | A | * | 8/1993 | Garneau | 2/414 |
| 5,269,025 | A | | 12/1993 | Broersma | 2/411 |
| 5,309,576 | A | * | 5/1994 | Broersma | 2/412 |
| 5,351,341 | A | | 10/1994 | Broersma | 2/412 |
| 5,351,342 | A | | 10/1994 | Garneau | 2/414 |
| 5,469,583 | A | | 11/1995 | Akeley et al. | 2/421 |
| 5,477,563 | A | | 12/1995 | Gentes et al. | 2/411 |
| 5,481,762 | A | | 1/1996 | Gentes et al. | 2/411 |
| 5,659,900 | A | | 8/1997 | Arney et al. | 2/417 |
| 5,675,843 | A | | 10/1997 | Grim et al. | 2/422 |
| 5,729,877 | A | | 3/1998 | Kong et al. | 24/625 |
| 5,774,901 | A | | 7/1998 | Minami | 2/421 |
| 5,833,796 | A | * | 11/1998 | Matich | 156/285 |
| 5,867,840 | A | * | 2/1999 | Hirosawa et al. | 2/414 |
| 5,887,288 | A | | 3/1999 | Arney et al. | 2/421 |
| 6,009,561 | A | | 1/2000 | Bullock et al. | 2/422 |
| 6,009,562 | A | | 1/2000 | Bullock et al. | 2/422 |
| 6,401,261 | B1 | | 6/2002 | Arney et al. | 2/421 |
| 6,421,840 | B1 | | 7/2002 | Chen et al. | 2/410 |
| 6,446,270 | B1 | | 9/2002 | Durr | 2/412 |
| 6,449,776 | B1 | | 9/2002 | Musal | 2/418 |
| 6,711,751 | B1 | | 3/2004 | Muskovitz | 2/410 |

(Continued)

FOREIGN PATENT DOCUMENTS

| | | |
|---|---|---|
| EP | 0 517 091 | 12/1992 |

(Continued)

OTHER PUBLICATIONS

Notification of Transmittal of International Search Report, mailed Oct. 17, 2005, regarding International Appl. No. PCT/US2005/253718.0—2314, 3 pages.

*Primary Examiner*—Rodney M. Lindsey
(74) *Attorney, Agent, or Firm*—Baker Botts L.L.P.

(57) ABSTRACT

According to one embodiment of the invention, a system for head protection is provided. The system includes a helmet body defining at least one hole. The system also includes at least one reinforcement member coupled to the helmet body. The reinforcement member defines an aperture that at least partially aligns with the hole of the helmet body.

30 Claims, 9 Drawing Sheets

U.S. PATENT DOCUMENTS

2002/0124298 A1* 9/2002 Muskovitz ..... 2/410

FOREIGN PATENT DOCUMENTS

JP 10-130939 8/1998

WO WO 91/13560 9/1991

WO WO 2004/006706 1/2004

* cited by examiner

HELMET REINFORCEMENT SYSTEM

TECHNICAL FIELD OF THE INVENTION

This invention relates generally to protective gear and more particularly to a helmet reinforcement system.

BACKGROUND OF THE INVENTION

A physical impact to the head of a person may cause serious injury or death. To reduce the probability of such consequences, protective gear, such as a helmet, is often used in activities that are associated with an increased level of risk for a head injury. Examples of such activities include, but are not limited to, skiing, snowboarding, bicycling, rollerblading, rock climbing, skate boarding, and motorcycling.

A helmet may include one or more holes that allow air to reach the head of a wearer. Such a feature enhances comfort for the wearer and may also reduce the likelihood of heat-related injuries. However, these holes may also weaken the ability of a helmet to protect the head against certain types of physical impact.

SUMMARY OF THE INVENTION

According to one embodiment of the invention, a system for head protection is provided. The system includes a helmet body defining at least one hole. The system also includes at least one reinforcement member coupled to the helmet body. The reinforcement member defines an aperture that at least partially aligns with the hole of the helmet body.

Some embodiments of the invention provide numerous technical advantages. Other embodiments may realize some, none, or all of these advantages. For example, according to certain embodiments, a helmet is strengthened by reinforcing one or more ventilation holes or other types of holes in the helmet. In other embodiments of the invention, a helmet's vulnerability to a penetrating force applied to or near a ventilation or other hole in the helmet is reduced by strengthening at least a portion of the area that defines the hole.

Other advantages may be readily ascertainable by those skilled in the art.

BRIEF DESCRIPTION OF THE DRAWINGS

Reference is now made to the following description taken in conjunction with the accompanying drawings, wherein like reference numbers represent like parts, in which.

DETAILED DESCRIPTION OF EXAMPLE EMBODIMENTS OF THE INVENTION

Embodiments of the invention are best understood by referring to FIGS. 1 through 9 of the drawings, like numerals being used for like and corresponding parts of the various drawings.

Figure 1:
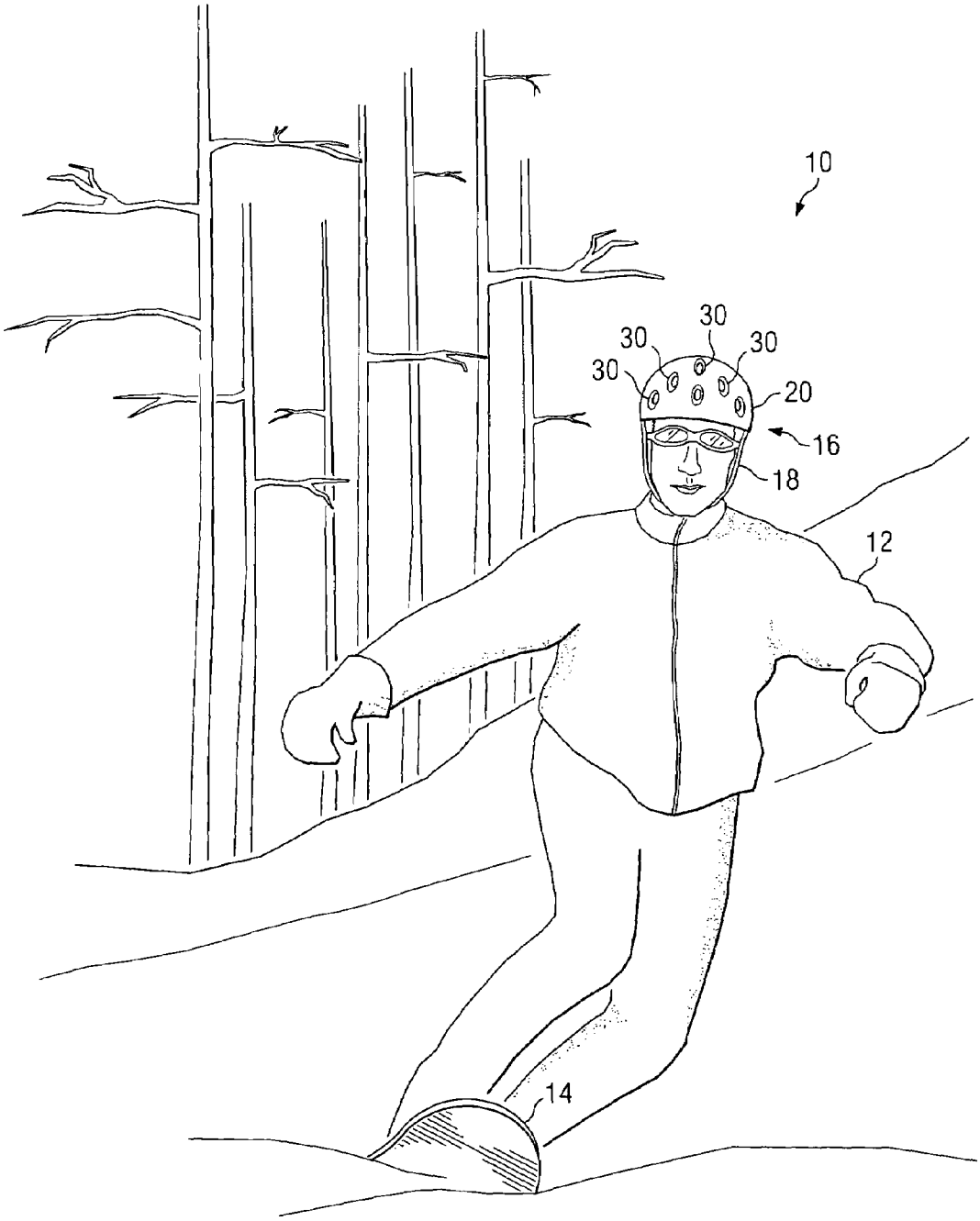
FIG. 1 illustrates an example of an activity where a helmet that may benefit from the teachings of the present invention may be used.

FIG. 1 is a schematic diagram illustrating one example of an environment 10 in which a helmet 20 according to one or more embodiments of the present invention may be used. As shown in FIG. 1, environment 10 includes a snowboarder (user) 12 on a snowboard 14 wearing helmet 20 on a head 16 of user 12. Helmet 20 is secured to head 16 of user 12 through the use of straps 18. Although one example of helmet 20 is shown as a snowboard helmet in FIG. 1, embodiments of the present invention may comprise or be used in conjunction with any type of protective headgear, such as a bicycle helmet, a motorcycle helmet, a hardhat, or the like.

Referring again to FIG. 1, if head 16 of user 12 were to experience physical impact due to an accident, such as a fall or a collision, user 12 may be injured. Because the use of a protective headgear such as helmet 20 may reduce the severity of trauma to head 16 in case of an impact, the use of helmet 20 is strongly encouraged for many activities where the probability of injury to head 16 is relatively high. Although helmet 20 is designed primarily for the protection of head 16 of user 12, helmet 20 may also be designed to increase the level of comfort for user 12. To that end, helmet 20 may define one or more holes 30 for ventilation. Holes 30 may also be referred to as vents 30.

Although holes 30 may increase the level of comfort for user 12, the region of helmet 20 defining each hole 30 is structurally weaker than other regions that do not define a hole 30. For example, where a penetrating object larger than hole 30 is forced into hole 30, the area defining the hole 30 may more readily give way to the penetrating object than other regions of helmet 20, which may allow the penetrating object to make direct impact with head 16 of user 12 and injure user 12.

According to certain embodiments of the present invention, a helmet reinforcement system and method are provided. For example, according to certain embodiments, a helmet is strengthened by reinforcing an area of the helmet that defines a hole with a reinforcement member having an aperture that approximately aligns with the hole. In other embodiments of the invention, a helmet's vulnerability to a penetrating force applied at a hole defined by the helmet is reduced by strengthening a portion of the area that defines the hole. Additional details of such example embodiments of the invention are described below in greater detail in conjunction with FIGS. 2A through 9.

Figure 2A:
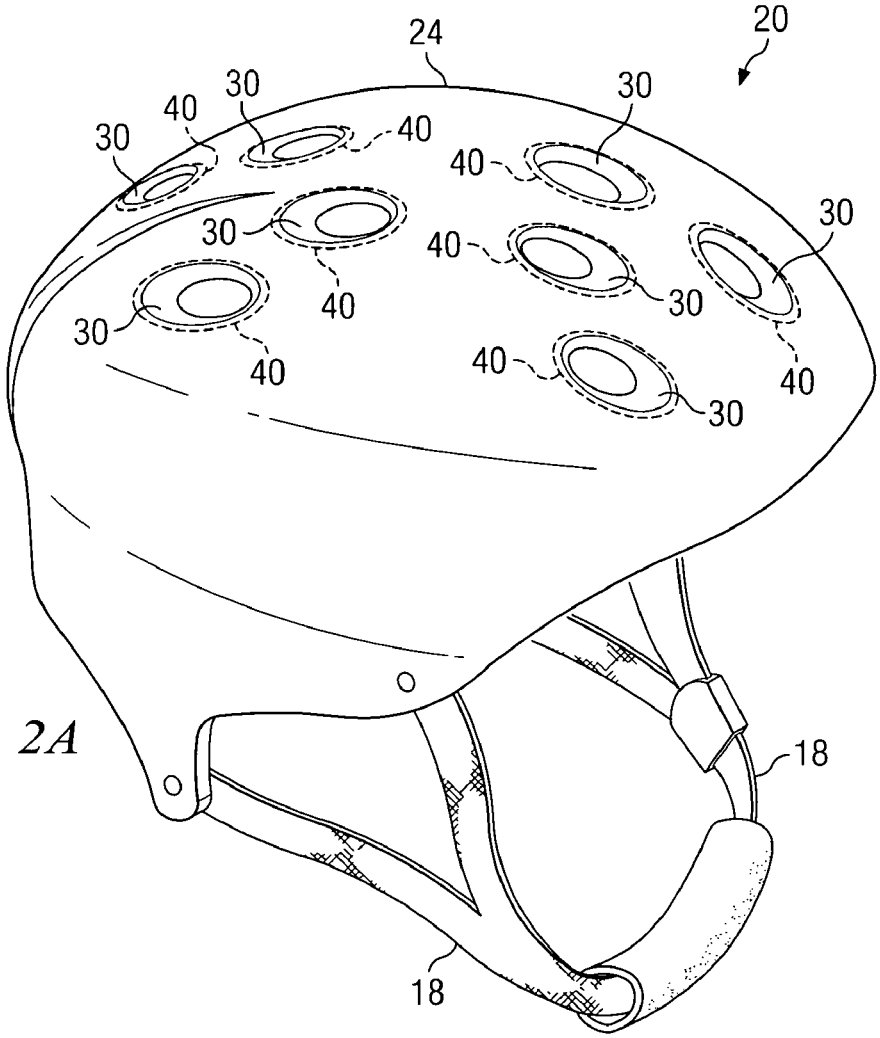
FIG. 2A is a perspective view of the helmet shown in FIG. 1.

FIG. 2A is a perspective view of helmet 20 shown in FIG. 1. Helmet 20 comprises a body 24, chin straps 18, and holes 30 that are defined by body 24. Body 24 may include single or multiple layers of the same or different material. For example, a layer formed from expanded polystyrene (EPS) and a layer of plastic overlying the layer of EPS may be body 24. As shown in FIG. 2A, holes 30 may have different shapes and sizes. Holes 30 may also have different cross-sectional side profiles, as described below in conjunction with FIGS. 2B through 2D. According to one embodiment of the invention, a plurality of reinforcement members 40 each defining an aperture are included in helmet 20 so that the aperture defined by each reinforcement member 40 approximately aligns with each corresponding hole 30 of helmet 20. FIG. 2A shows reinforcement member 40 using a phantom loop to indicate that reinforcement member 40 may be embedded into body 24 of helmet 20. However, in certain embodiments, reinforcement member 40 may partially or wholly protrude out from the outer surface of helmet 20. Furthermore, in certain embodiments reinforcement member 40 may be an open enclosure rather than a closed loop. In such embodiments, an area at least partially enclosed by reinforcement member 40 is referred to as an aperture.

In certain embodiments, reinforcement member 40 is made from a material that is tougher and less flexible than the material from which body 24 is formed. For example, where body 24 is formed from a layer of expanded polystyrene (EPS) and a plastic layer overlying the layer of EPS, reinforcement member 40 may be formed from polycarbonate plastic, acrylonitrile-butadiene-styrene (ABS), carbon fiber, fiberglass, stainless steel, platinum, titanium, or any other suitable material. However, in certain embodiments, reinforcement member 40 may formed from a material that is weaker than the material from which body 24 is formed. In certain embodiments, reinforcement member 40 may be positioned near the outer surface of helmet 20. However, reinforcement member 40 may be positioned anywhere between the inner surface and the outer surface of helmet 20, and anywhere on the outer surface of helmet 20.

Figure 2B:
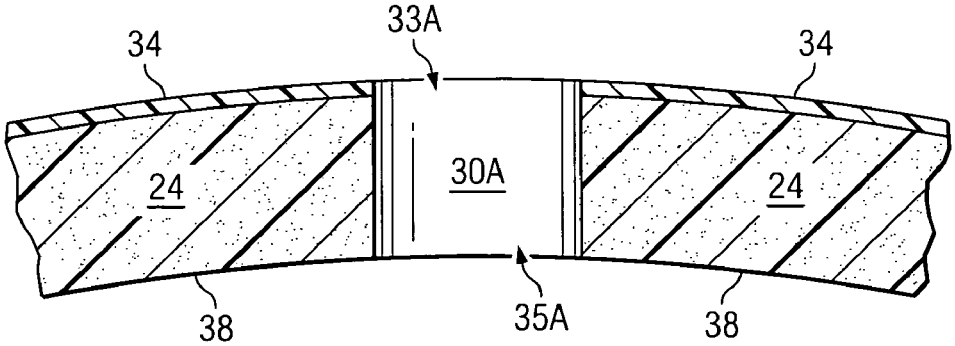
FIGS. 2B through 2D each shows a cross-sectional view of different embodiments of a hole defined by the helmet shown in FIG. 2A.
Figure 2C:
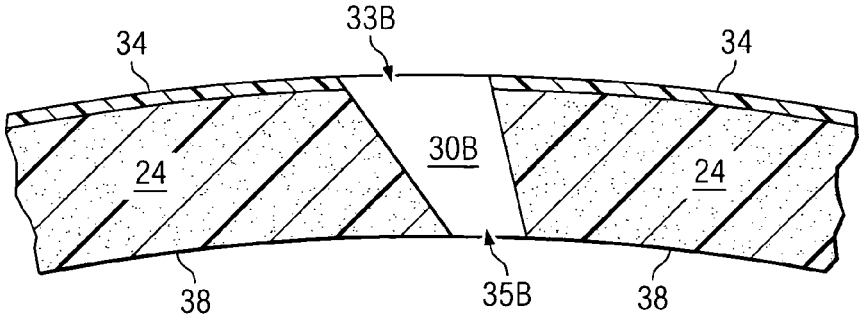
Figure 2D:
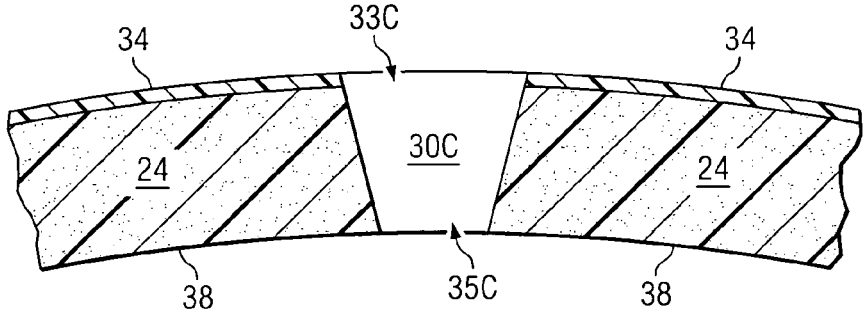

FIGS. 2B through 2D each illustrates a side cross-sectional view of different embodiments of holes 30 that may be included in helmet 20 shown in FIG. 2A. FIGS. 2B through 2D are described jointly. Referring to FIG. 2B, body 24 of helmet 20 comprises an outer surface 34 and an inner surface 38. Inner surface 38 is the surface that faces head 16 of user 12, and outer surface 34 is the surface that faces outwardly from head 16. As shown in FIG. 2B, body 24 defines a hole 30A having an opening 33A defined at outer surface 34 and an opening 35A defined at inner surface 38. As shown in FIG. 2B, hole 30A comprises a relatively constant diameter throughout the length of hole 30A. Referring to FIG. 2C, body 24 defines a hole 30B having an opening 33B defined at outer surface 34 and an opening 35B at inner surface 38. As shown in FIG. 2C, hole 30B has a larger opening 33B at outer surface 34 than opening 35B at inner surface 38. Further, hole 30B has a cross-sectional side profile that is non-symmetrical and increases in diameter as hole 30B approaches outer surface 34. Referring to FIG. 2D, body 24 defines a hole 30C having an opening 33C defined at outer surface 34 and an opening 35C defined at inner surface 38. As shown in FIG. 2D, opening 33C is larger than opening 35C, and hole 30C has a cross-sectional side profile that is approximately symmetrical and increases in diameter as hole 30C approaches outer surface 34. Although FIGS. 2C and 2D show respective holes 33B and 33C increasing in diameter as they near outer surface 34, in some embodiments, holes 33B and 33C may decrease in diameter as they near outer surface 34. In some embodiments, holes 33B and 33C may have varying diameters throughout their respective lengths. Holes 30A–30C respectively shown in FIGS. 2B–2D are collectively referred to as holes 30. Openings 33A–33C defined at outer surface 34 respectively shown in FIGS. 2B–2D are collectively referred to as openings 33. Openings 35A–35C defined at inner surface 38 respectively shown in FIGS. 2B–2D are collectively referred to as openings 35.

Figure 3A:
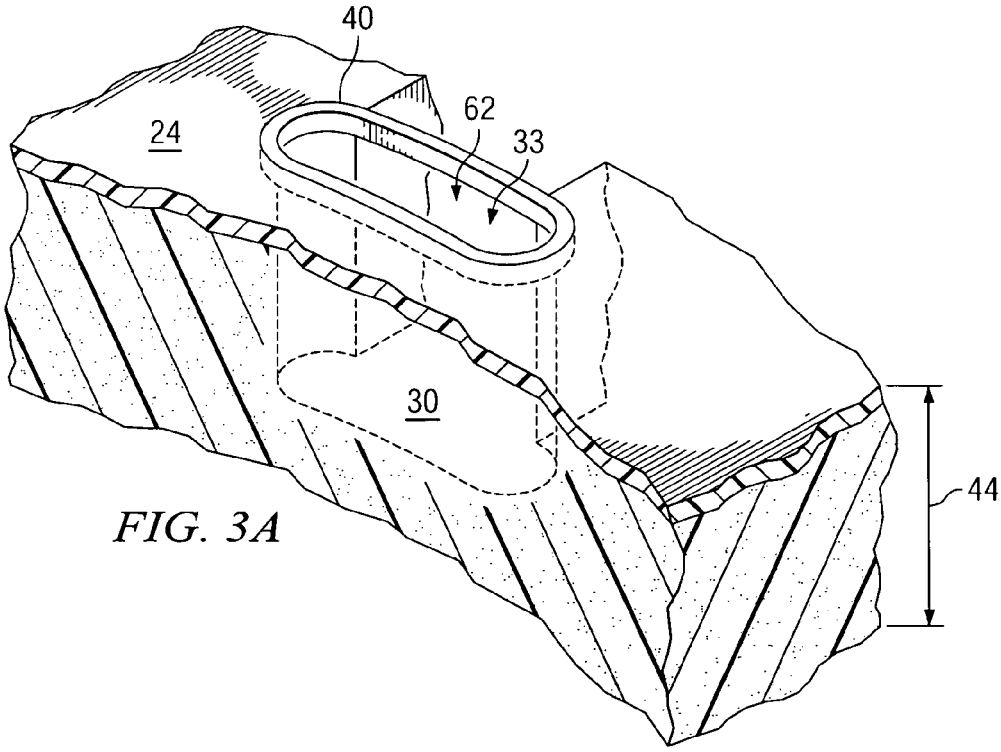
FIG. 3A is a perspective view of a reinforcement member defining an aperture positioned in an approximate alignment with the hole shown in FIG. 2B.
Figure 3B:
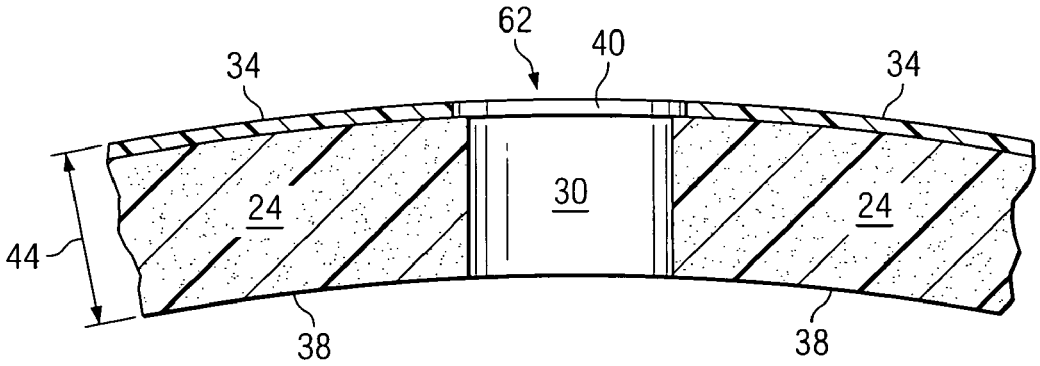
FIG. 3B is a side cross-sectional view of the hole and the reinforcement member shown in FIG. 3A.

FIG. 3A is a perspective view of one embodiment of reinforcement member 40, where an aperture 62 defined by reinforcement member 40 is positioned in approximate alignment with hole 30. FIG. 3B is a side cross-sectional view of reinforcement member 40 and hole 30 shown in FIG. 3A. FIGS. 3A and 3B are described jointly. Referring to FIG. 3A, hole 30 is defined by body 24 having a thickness 44. In certain embodiments, thickness 44 is in a range of approximately 1.0–2.0 inches. However, any suitable thickness 44 may be used. As shown in FIGS. 3A and 3B, in certain embodiments, reinforcement member 40 may be positioned in proximity to opening 33 defined at outer surface 34 of helmet 20. However, reinforcement member 40 may be positioned anywhere along thickness 44 of body 24 shown in FIG. 3B. In certain embodiments, positioning reinforcement member 40 near outer surface 34 is advantageous because such a position allows reinforcement member 40 to engage a penetrating object further away from head 16 of user 12, which decreases the probability of injury. In certain embodiments, reinforcement member 40 is positioned within 0.5 inches from outer surface 34. Although reinforcement member 40 is shown as a closed loop in FIGS. 3A and 3B, reinforcement member 40 may be in any suitable shape—open or closed—that allows reinforcement member 40 to resist an expansion of aperture 62 defined by reinforcement member 40. Examples of suitable shapes for reinforcement member 40 include, but are not limited to, a rectangle, a triangle, a trapezoid, a hexagon, an octagon, a circle, and an oval.

Figure 4A:
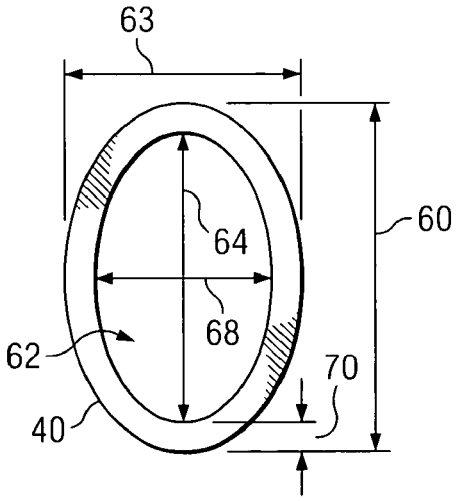
FIG. 4A is a top view of a reinforcement member in accordance with one embodiment of the present invention.
Figure 4B:
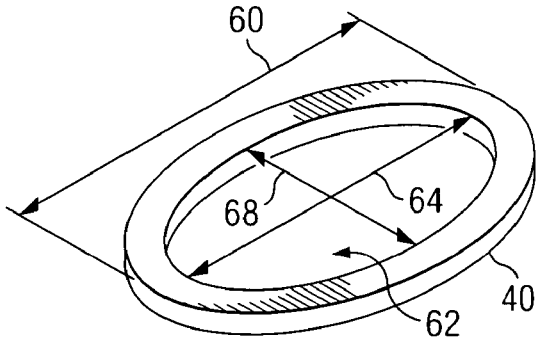
FIG. 4B is a perspective view of the reinforcement member shown in FIG. 4A.
Figure 4C:
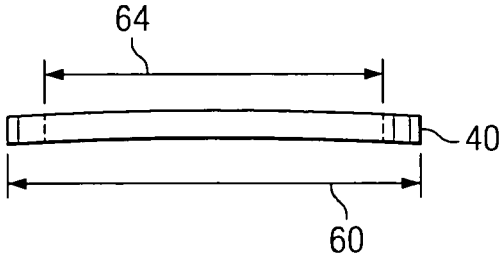
FIG. 4C is a side view of the reinforcement member shown in FIG. 4A.
Figure 4D:
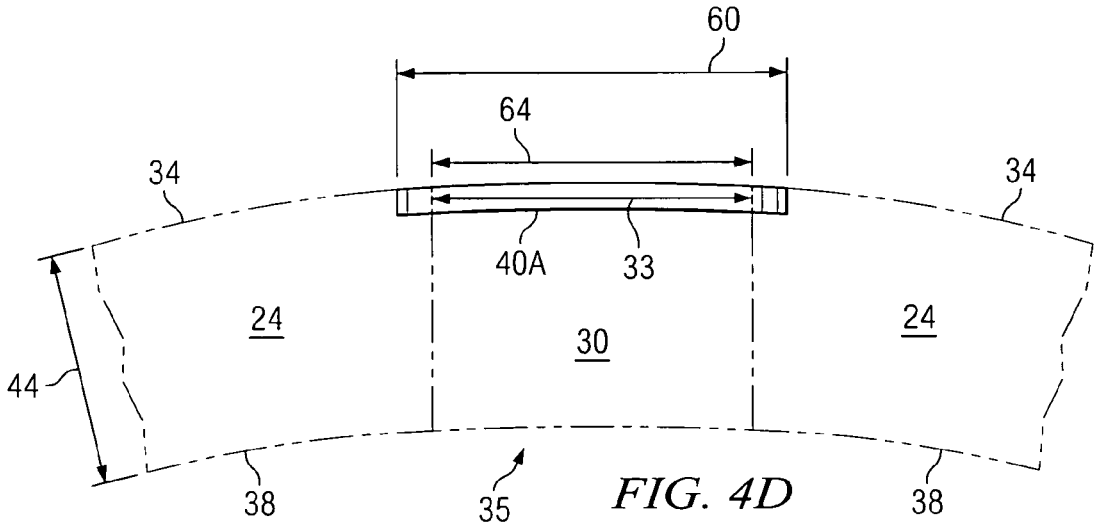
FIG. 4D is a side cross-sectional view of the reinforcement member shown in FIGS. 4A through 4C positioned in approximate alignment with the hole shown in FIG. 2B.

FIG. 4A is a top view of one embodiment of reinforcement member 40 shown in FIG. 3A. FIG. 4B is a perspective view of reinforcement member 40 shown in FIG. 4A. FIG. 4C is a side view of reinforcement member 40 shown in FIG. 4A. FIG. 4D is a side cross-sectional view of one embodiment of reinforcement member 40 shown in FIGS. 4A through 4C, where aperture 62 defined by reinforcement member 40 is positioned in approximate alignment with hole 30 shown in FIG. 2B. FIGS. 4A through 4D are described jointly. As shown in FIGS. 4A–4C, reinforcement member 40 comprises major and minor diameters 60 and 63, a width 70, and defines aperture 62 having a plurality of diameters 64 and 68. In some embodiments, a diameter refers to the length of straight line segment passing through the center of a figure, such as reinforcement member 40, and terminating at a periphery of the figure. Referring to FIG. 4D, reinforcement member 40 may comprise a side profile that allows reinforcement member 40 to conform to the contour of outer surface 34 of helmet 20. For example, as shown in FIG. 4D, a reinforcement member 40A comprises a curved side profile to conform to the curved contour of outer surface 34.

In certain embodiments, the size and shape of aperture 62 may be approximately equal to the size and shape of a portion of hole 30 where reinforcement member 40 is positioned. For example, where reinforcement member is position near outer surface 34, aperture 62 may have an approximately same size and shape as opening 33 defined at outer surface 34. In certain embodiments, width 70 of reinforcement member 40 is such that reinforcement member 40 can be supported by the area of body 24 that defines hole 30. Any suitable width 70 may be selected based on the protection requirements of helmet 20.

Figure 5A:
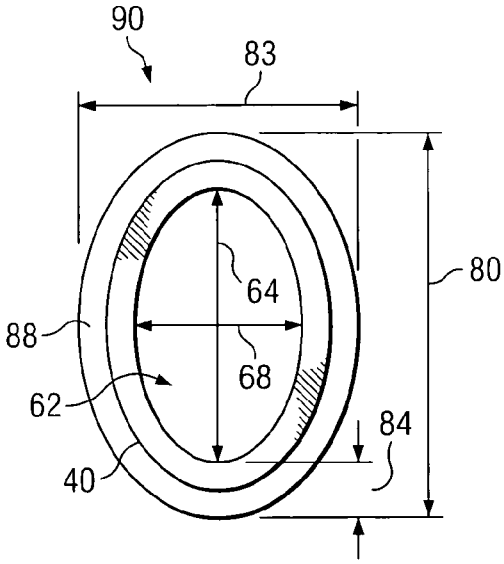
FIG. 5A is a top view of a reinforcement member in accordance with another embodiment of the present invention.
Figure 5B:
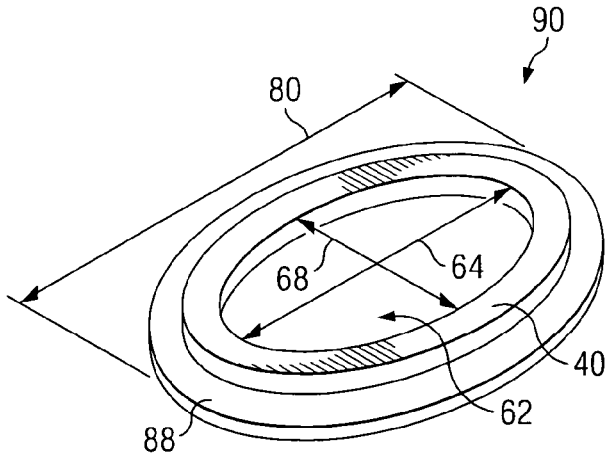
FIG. 5B is a perspective view of the reinforcement member shown in FIG. 5A.
Figure 5C:
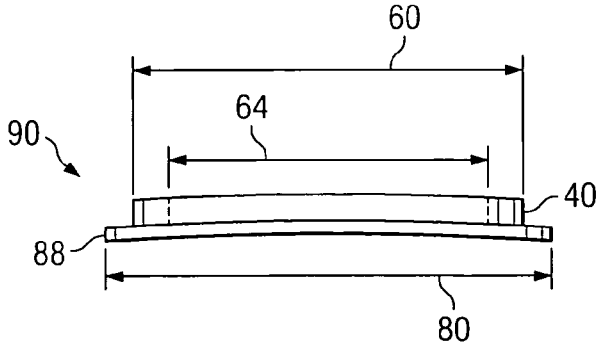
FIG. 5C is a side view of the reinforcement member shown in FIG. 5A.
Figure 5D:
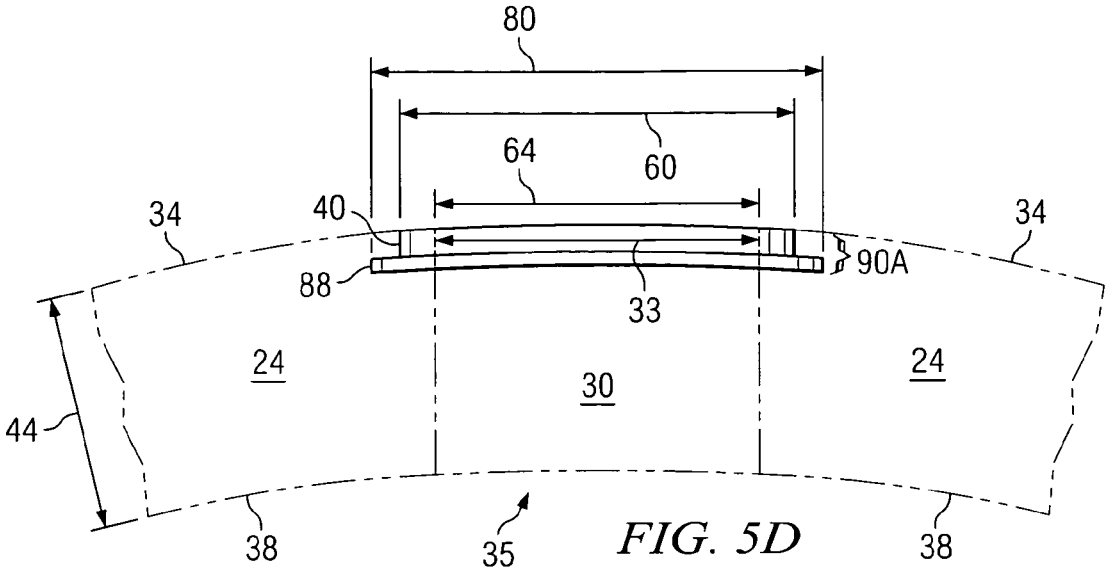
FIG. 5D is a side cross-sectional view of the reinforcement member shown in FIGS. 5A through 5C positioned in approximate alignment with the hole shown in FIG. 2B.

FIG. 5A is a top view of one embodiment of a reinforcement member 90 that may be used to strengthen helmet 20 shown in FIG. 2A. FIG. 5B is a perspective view of reinforcement member 90 shown in FIG. 5A. FIG. 5C is a side view of reinforcement member 90 shown in FIG. 5A. FIG. 5D is a side cross-sectional view of one embodiment of reinforcement member 90 shown in FIGS. 5A through 5C, where aperture 62 is positioned in alignment with hole 30 shown in FIG. 2B. FIGS. 5A through 5D are described jointly. As shown in FIG. 5A, in one embodiment, reinforcement member 90 includes reinforcement member 40 supported by a flange 88. Reinforcement member 90 defines aperture 62 that has major and minor diameters 64 and 68. Reinforcement member 90 has major and minor diameters 80 and 83, and a width 84. Diameter 80 and width 84 are greater than diameter 60 and width 70 (shown in FIG. 4A). This is advantageous in some embodiments because flange 88 strengthens reinforcement member 40 and also provides a larger contact area between reinforcement member 90 and body 24 of helmet 20. Thus, force that urges reinforcement member 90 against body 24 of helmet 20 is more widely distributed on body 24, which allows reinforcement member 90 to bear a greater load that may be experienced in an impact with a penetrating object.

In certain embodiments, diameter 64 is in a range of approximately 1.5–2.5 inches, diameter 68 is in a range of approximately 0.5–1.0 inches, diameter 80 is in a range of approximately 1.75–3.00 inches, and diameter 83 is in a range of approximately 0.75–1.5 inches. Width 84 is in a range of approximately 0.2–0.5 inches. The ranges of diameters 64 and 68 may also apply to aperture 62 shown in FIGS. 4A–4D. Although certain ranges are described above as examples, any suitable diameters 64, 68, 80, 83, and any suitable width 84 may be used depending on the material used to form reinforcement members 40 and 90, the material used to form body 24, thickness 44, and the protection requirements of helmet 20. Referring to FIG. 5D, reinforcement member 90 may comprise a side profile that allows reinforcement member 90 to conform to the contour of outer surface 34 of helmet 20. For example, as shown in FIG. 5D, reinforcement member 90 comprises a curved side profile to conform to the curved contour of outer surface 34.

Although FIGS. 4D and 5D show aperture 62 defined by reinforcement member 40 as having the same size and shape as opening 33 and directly aligned with opening 33, aperture 62 may be smaller or larger than hole 30, and may not be exactly aligned with opening 33. In certain embodiments, aperture 62 has a different size and shape than hole 30 and includes at least one dimension, such as diameter 64 or 68, that is small enough to engage a conical penetrating object before the penetrating object reaches inner opening 35 of hole 30.

Figure 6A:
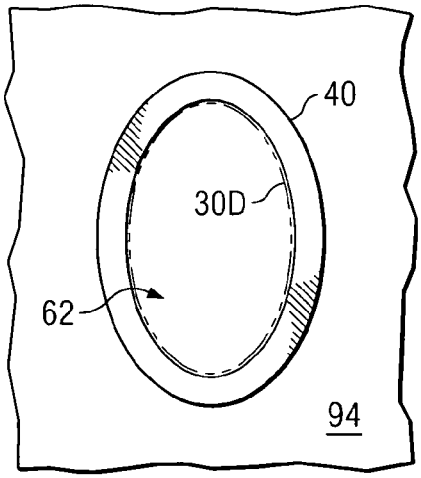
FIGS. 6A through 6E shows a top view of further embodiments of reinforcement members in accordance with the present invention positioned in approximate alignment with the hole shown in FIG. 2B.
Figure 6B:
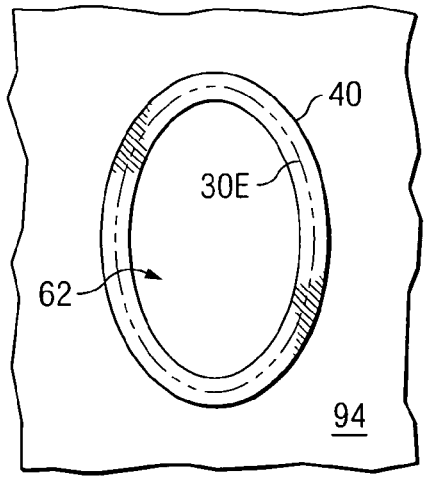

FIGS. 6A through 6E each shows a top view of a particular embodiment of reinforcement member 40 shown in FIG. 3A, where aperture 62 is positioned in approximate alignment with hole 30 shown in FIG. 2B. FIGS. 6A through 6E are described jointly. FIGS. 6A through 6E show hole 30 using a phantom loop. As shown in FIG. 6A, in certain embodiments, the size and shape of aperture 62 is approximately the same as the size and shape of a hole 30D. As shown in FIG. 6B, in certain embodiments, aperture 62 defined by reinforcement member 40 may be smaller than a hole 30E, provided that outer diameter 60 (shown in FIG. 4A) and thickness (shown in FIG. 4A) are sufficient enough to engage at least a portion of the area of body 24 that defines hole 30 to sufficiently resist force applied on reinforcement member 40 against body 24 of helmet 20.

Figure 6C:
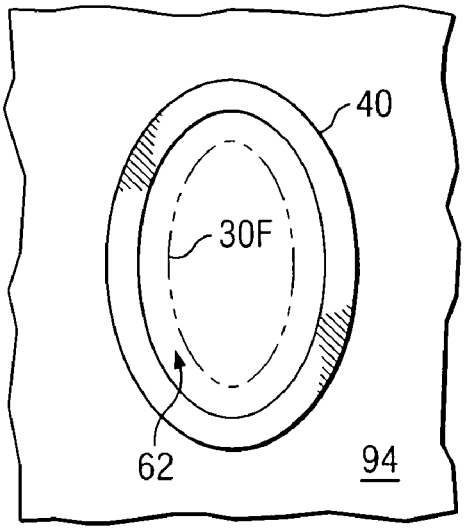
Figure 6D:
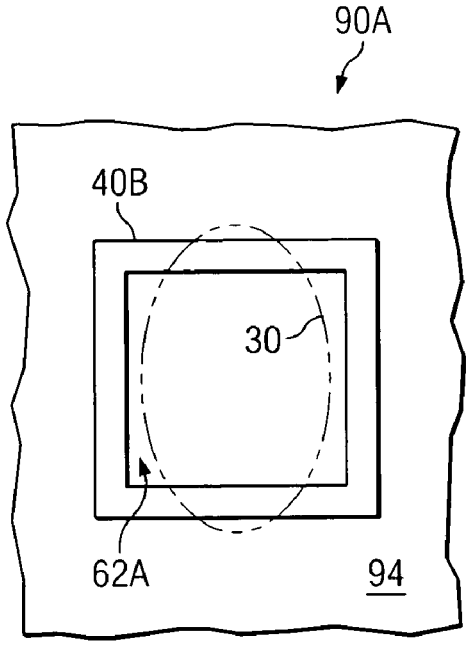
Figure 6E:
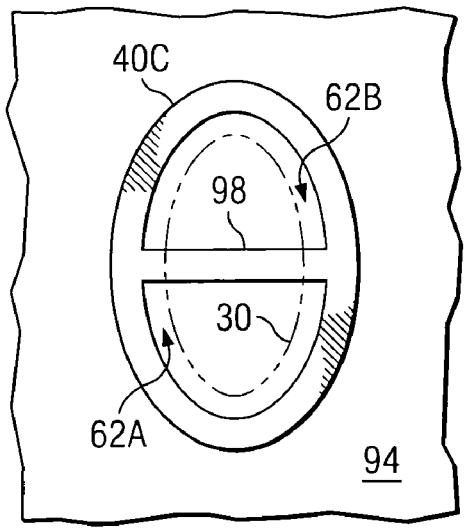

As shown in FIG. 6C, in certain embodiments, aperture 62 defined by reinforcement member 40 may be larger than a hole 30F, provided that at least one dimension of aperture 62, such as a diameter, is small enough to engage a penetrator before any portion of the penetrator breaks the curved plane defined by inner surface 38 of helmet 20. Referring to FIG. 6D, in certain embodiments, a reinforcement member 40B having a different shape than hole 30 may be used to reinforce hole 30. Reinforcement member 40B defines a rectangular aperture 62A. Aperture 62A includes at least one dimension, such as a diameter, that is small enough to engage a penetrator before any portion of the penetrator breaks a curved plane defined by inner surface 38 of helmet 20. Although the shape of reinforcement member 40B is shown as a rectangle in FIG. 6D, any suitable shape may be used. Referring to FIG. 6E, in certain embodiments, a reinforcement member 40C may include a cross-member 98 that cuts across aperture 62, thus defining apertures 62A and 62B. More than one cross-member 98 may be used to provide additional support for reinforcement member 40C. This is advantageous in certain embodiments because using cross-member 98 improves reinforcement member's 40C ability to maintain diameter 68 (shown in FIG. 4A) when a penetrator is forced into reinforcement member 40C.

Figure 7A:
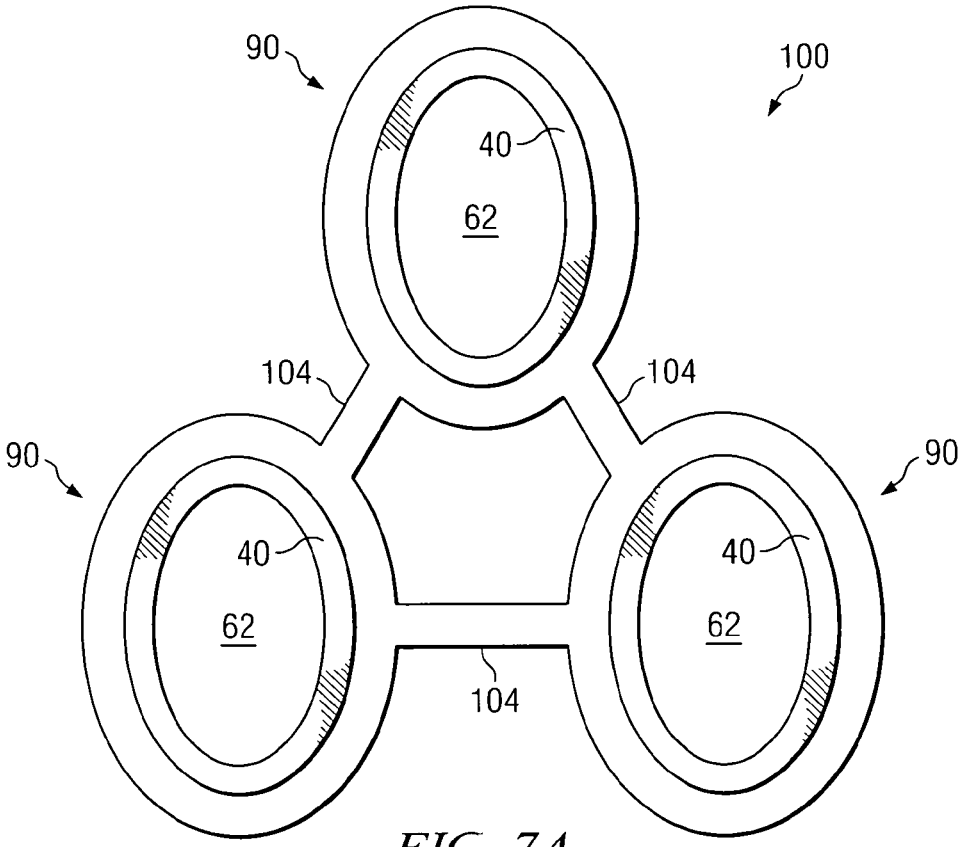
FIGS. 7A and 7B each shows a top view of a cluster of reinforcement members that may be used to reinforce a plurality of holes defined by the helmet shown in FIG. 2A.
Figure 7B:
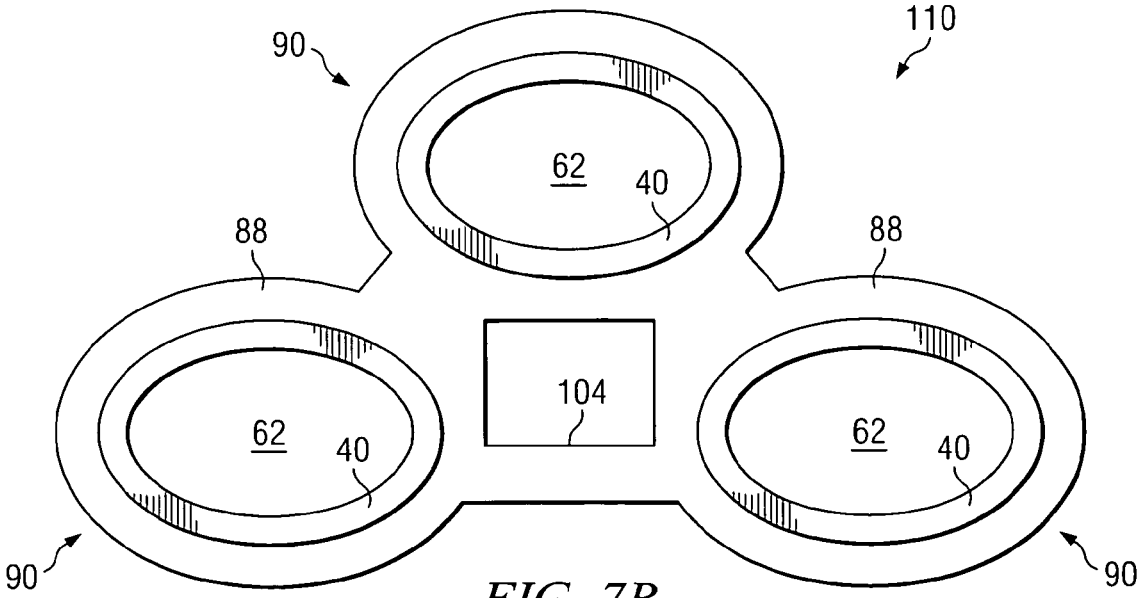

FIG. 7A is a top view of a cluster 100 of reinforcement members 90 that may be used to reinforce a particular set of holes 30 defined by helmet 20 shown in FIG. 2A. FIG. 7B is a top view of a cluster 110 of reinforcement members 90 that may be used to reinforce another set of holes 30 defined by helmet 20 shown in FIG. 2A. Referring to FIG. 7A, cluster 100 comprises a plurality of reinforcement members 90 that are joined by extensions 104. Each reinforcement member 90 defines an aperture 62. Extensions 104 have a combination of length and orientation that positions each aperture 62 in approximate alignment with corresponding hole 30 of helmet 20. As shown in FIG. 7B, cluster 110 comprises a plurality of reinforcement members 90, where at least some of reinforcement members 90 are joined directly at flange 88 rather than through extension 104. The use of such clusters 100 and/or 110 is advantageous in some embodiments of the invention because the number of separate parts that need to be managed during the manufacture of helmet 20 is reduced.

Figure 8:
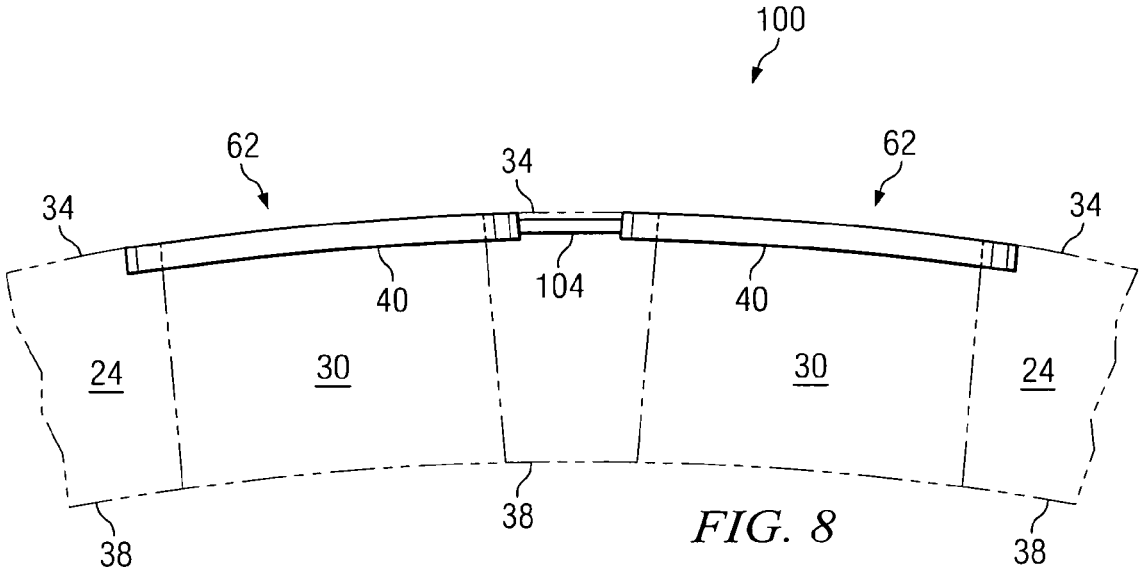
FIG. 8 is a side view of the cluster of reinforcement members positioned in approximate alignment with a plurality of holes shown in FIG. 2A.

FIG. 8 is a side view of cluster 100, where apertures 62 of reinforcement members 90 are positioned in approximate alignment with respectively corresponding holes 30 shown in FIG. 2A. The extension 104 illustrated in FIG. 8 has a particular length and orientation that approximately aligns aperture 62 with respective hole 30. In certain embodiments, cluster 100 may comprise a side profile that allows cluster 100 to conform to the contour of outer surface 34 of helmet 20. For example, as shown in FIG. 8, cluster 100 comprises a curved side profile to conform to the curved contour of outer surface 34.

Figure 9:
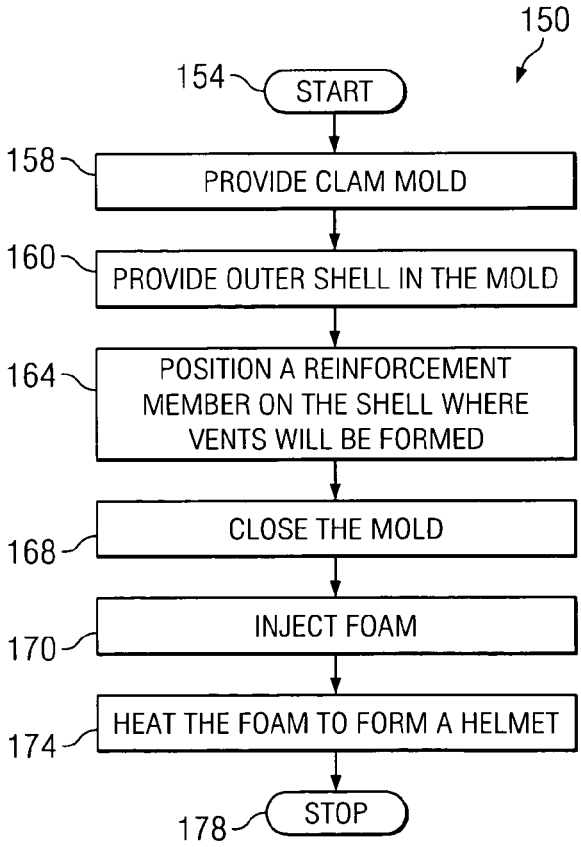
FIG. 9 is a flowchart illustrating one embodiment of a method for reinforcing the holes defined by the helmet shown in FIG. 2A.

FIG. 9 is a flowchart illustrating one embodiment of a method 150 for reinforcing holes 30 defined by helmet 20 shown in FIG. 2A. Method 150 starts at step 154. At step 158, a clam shell mold having a reverse shape of a helmet to be made is provided. The clam shell mold provided at step 158 defines a plurality of structures that designate the location of holes 30 of helmet 20. At step 160, an outer shell may be laid in the clam shell mold of step 158. The outer shell may be formed from a sheet of plastic and may be used to display color, design, and logo for the helmet. The outer shell may also provide a layer of protection against dirt and weather for the helmet. The outer shell includes holes so that the structures of the clam shell mold may fit through the holes of the outer shell. At step 164, a reinforcement member, such as reinforcement member 90, is positioned around the structure of the clam shell mold that identifies the position of hole 30. At step 168, the mold is closed. At step 170, a material is injected into the clam shell mold. In certain embodiments, EPS may be injected into the clam shell mold at step 170; however, any suitable material may be used. At step 174, the material and the outer shell are heated to form body 24 of helmet 20. Method 150 stops at step 178 (although other steps may be performed to add additional features to the helmet, such as a retention system). Method 150 described above is one of many ways that different embodiments of reinforcement members 40/90 may be coupled to helmet 20.

Although some embodiments of the present invention have been described in detail, it should be understood that various changes, substitutions, and alterations can be made hereto without departing from the spirit and scope of the invention as defined by the appended claims.

What is claimed is:

1. A system for head protection, comprising:

a helmet body, the helmet body comprising a shock-absorbent layer and an outer shell overlying the shock-absorbent layer, the shock-absorbent layer defining at least one hole; and at least one reinforcement member coupled to the shock-absorbent layer, wherein the reinforcement member:

defines an aperture that at least partially aligns with the hole of the shock-absorbent layer;

has a thickness substantially less than the thickness of the shock-absorbent layer defining the hole; and is substantially the same size as the hole.

2. The system of claim 1, wherein the aperture has the same size and the same shape as the hole.

3. The system of claim 1, wherein the aperture and the hole are substantially aligned.

4. The system of claim 1, wherein the hole and the aperture have at least one approximately identical diameter.

5. The system of claim 1, wherein the at least one hole and the at least one reinforcement member each comprises a substantially oval shape.

6. The system of claim 1, wherein the shock-absorbent layer comprises an outer surface and an inner surface, the hole extending from the outer surface to the inner surface, and wherein the reinforcement member is positioned no more than 0.5 inches from the outer surface.

7. The system of claim 1, wherein the shock-absorbent layer comprises an outer surface and an inner surface, and wherein the reinforcement member is positioned closer to the outer surface than to the inner surface.

8. The system of claim 1, wherein the shock-absorbent layer comprises an outer surface and the hole comprises an opening defined at the outer surface, and wherein the aperture has an approximately same size and an approximately same shape as the opening.

9. The system of claim 1, wherein the shock-absorbent layer comprises an outer surface, and the member is positioned approximately at the outer surface.

10. The system of claim 1, wherein the shock-absorbent layer is formed from one or more first materials and the reinforcement member is formed from a second material that is tougher than the one or more first materials.

11. The system of claim 1, wherein at least a portion of the region of the shock-absorbent layer defining the hole is formed from expanded polystyrene and the reinforcement member is formed from a polycarbonate plastic.

12. The system of claim 1, wherein at least a portion of the region of the shock-absorbent layer defining the hole is formed from expanded polystyrene and the reinforcement member is formed from carbon fiber.

13. The system of claim 1, wherein the shell defines an opening corresponding to the hole, wherein the reinforcement member is embedded into the shell.

14. The system of claim 1, wherein the reinforcement member is disposed between the shock-absorbent layer and the shell.

15. The system of claim 1, wherein:

a first reinforcement member is associated with a first hole and a second reinforcement member is associated with a second hole; and at least the first and second reinforcement members are joined directly or by an extension to form a cluster.

16. A system for head protection, comprising:

a helmet body, the helmet body comprising a shock-absorbent layer and an outer shell overlying the shock-absorbent layer, the shock-absorbent-layer having an outer surface and defining at least one hole having an opening at the outer surface, the opening having a size and a shape; and at least one reinforcement member positioned in proximity of the outer surface of the shock-absorbent layer, the reinforcement member defining an aperture that at least partially aligns with the opening, the aperture having an approximately same size and shape as the opening, the reinforcement member being substantially the same size as the hole.

17. The system of claim 16, wherein the opening and the aperture are substantially aligned.

18. The system of claim 16, wherein the reinforcement member is positioned no more than 0.5 inches from the outer surface.

19. The system of claim 16, wherein the shock-absorbent layer comprises an inner surface, and wherein the reinforcement member is positioned closer to the outer surface than to the inner surface.

20. The system of claim 16, wherein the shock-absorbent layer is formed from one or more first materials and the reinforcement member is formed from a second material that is tougher than the one or more first materials.

21. The system of claim 16, wherein at least a portion of the region of the shock-absorbent layer defining the hole is formed from expanded polystyrene and the reinforcement member is formed from a polycarbonate plastic.

22. The system of claim 16, wherein at least a portion of the region of the shock-absorbent layer defining the hole is formed from expanded polystyrene and the reinforcement member is formed from carbon fiber.

23. The system of claim 16, wherein the shell defines an opening corresponding to the hole, wherein the reinforcement member is embedded into the shell.

24. The system of claim 16, wherein the reinforcement member is disposed between the shock-absorbent layer and the shell.

25. The system of claim 16, wherein the opening and the at least one reinforcement member each comprises a substantially oval shape.

26. The system of claim 16, wherein:

a first reinforcement member is associated with a first hole and a second reinforcement member is associated with a second hole; and at least the first and second reinforcement members are joined directly or by an extension to form a cluster.

27. A system for head protection, comprising:

a first means for absorbing shock defining at least one hole;

a second means for absorbing shock overlying the first means; and at least one means for reinforcement of the first means for absorbing shock, the means for reinforcement:

defining an aperture that at least partially aligns with the at least one hole of the first means for absorbing shock;

having a thickness substantially less than the thickness of the first means for absorbing shock; and being substantially the same size as the hole.

28. The system of claim 27, wherein:

a first means for reinforcement is associated with a first hole and a second means for reinforcement is associated with a second hole; and at least the first and second means for reinforcement are joined directly or by an extension to form a cluster.

29. A system for head protection, comprising:

a helmet body, the helmet body comprising a shock-absorbent layer and an outer shell overlying the shock-absorbent layer, the shock-absorbent layer:

formed from a first material;

having an outer surface and an inner surface; and defining a plurality of holes, each hole extending from the outer surface to the inner surface and comprising an opening having a size and a shape at the outer surface; and a plurality of reinforcement members formed from a second material that is tougher and less flexible than the first material and positioned in proximity of the outer surface of the shock-absorbent layer, each reinforcement member:

having a one-to-one correspondence with a particular hole;

defining an aperture having an approximately same size and shape as the opening of the particular hole, wherein the aperture of each reinforcement member substantially aligns with the opening of the particular hole; and being substantially the same size as the hole.

30. The system of claim 29, wherein at least one reinforcement member is joined directly or by an extension to at least one other reinforcement member to form a cluster.

* * * * *